US009221634B2

(12) United States Patent
Tanaka et al.

(10) Patent No.: US 9,221,634 B2
(45) Date of Patent: Dec. 29, 2015

(54) RECORDING MEDIUM FEEDING DEVICE AND IMAGE FORMING APPARATUS PROVIDED WITH SAME

(71) Applicant: KYOCERA Document Solutions Inc., Osaka (JP)

(72) Inventors: Yuichiro Tanaka, Osaka (JP); Takehiro Sato, Osaka (JP); Hideaki Doyo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/600,434

(22) Filed: Jan. 20, 2015

(65) Prior Publication Data

US 2015/0203307 A1 Jul. 23, 2015

(30) Foreign Application Priority Data

Jan. 21, 2014 (JP) ..... 2014-008475

(51) Int. Cl.
*B65H 3/06* (2006.01)

(52) U.S. Cl.
CPC ..... *B65H 3/0684* (2013.01); *B65H 2402/31* (2013.01); *B65H 2402/32* (2013.01); *B65H 2402/341* (2013.01); *B65H 2404/152* (2013.01); *B65H 2404/1521* (2013.01)

(58) Field of Classification Search
CPC ..... B65H 3/0684; B65H 2402/31; B65H 2402/312; B65H 2404/152; B65H 2404/1521
USPC ..... 271/117
See application file for complete search history.

(56) References Cited

U.S. PATENT DOCUMENTS

| | | | | |
|---|---|---|---|---|
| 5,462,267 | A * | 10/1995 | Hori | 271/10.04 |
| 7,523,933 | B2 * | 4/2009 | Linder et al. | 271/274 |
| 8,002,267 | B2 * | 8/2011 | Iemura et al. | 271/117 |
| 8,636,275 | B2 * | 1/2014 | Kambayashi et al. | 271/3.17 |
| 8,708,330 | B2 * | 4/2014 | Hida | 271/117 |
| 2004/0245704 | A1 * | 12/2004 | Hall et al. | 271/117 |
| 2008/0122162 | A1 * | 5/2008 | Bokelman et al. | 271/124 |
| 2009/0014940 | A1 * | 1/2009 | Lim | 271/3.14 |
| 2013/0193632 | A1 * | 8/2013 | Hida | 271/10.11 |

FOREIGN PATENT DOCUMENTS

| | | |
|---|---|---|
| JP | 5-132194 A | 5/1993 |
| JP | 6-64769 A | 3/1994 |

* cited by examiner

*Primary Examiner* — Patrick Cicchino
(74) *Attorney, Agent, or Firm* — Stein IP, LLC

(57) ABSTRACT

According to the present disclosure, a recording medium feeding device includes a pickup roller, a feed roller, a retard roller, a holding member, a pressing mechanism, a pressing force changing mechanism, and a driving force transmitting mechanism. The holding member is configured to rotatably support the feed roller and the pickup roller. The pressing mechanism is configured to press the pickup roller against a recording medium. The pressing force changing mechanism is configured to change the pressing force of the pickup roller. The driving force transmitting mechanism is configured to transmit a rotation-driving force to the feed roller. The pressing force changing mechanism obtains a driving force from the driving force transmitting mechanism, and increases the pressing force according to rotation time of the pickup roller.

6 Claims, 3 Drawing Sheets

RECORDING MEDIUM FEEDING DEVICE AND IMAGE FORMING APPARATUS PROVIDED WITH SAME

INCORPORATION BY REFERENCE

This application is based upon and claims the benefit of priority from the corresponding Japanese Patent Application No. 2014-008475 filed on Jan. 21, 2014, the entire contents of which are incorporated herein by reference.

BACKGROUND OF THE INVENTION

The present disclosure relates to a recording medium feeding device and an image forming apparatus provided with the same, and in particular, relates to a recording medium feeding device including a pickup roller that feeds a recording medium from a recording medium stacking portion, and an image forming apparatus provided therewith.

There have conventionally been known image forming apparatuses provided with a pickup roller that feeds a sheet from a sheet feeding cassette (a recording medium stacking portion) in which the sheet (a recording medium) is stored. The pickup roller feeds the sheet by rotating while being pressed against a topmost surface of sheet stacked in the sheet feeding cassette.

Typically, image forming apparatuses are required to have a sheet feeding device (a recording medium feeding device) capable of handling various types of sheets from a thin sheet having a basis weight of about 50 g/m$^2$ to a thick sheet having a basis weight of about 300 g/m$^2$. A higher conveyance force is necessary to convey thick sheets than to convey thin sheets. Thus, for conveyance of thick sheets, a pressing force of the pickup roller against the sheets is set high.

On the other hand, there has been proposed a sheet feeding device provided with a pressing force changing mechanism configured to change the pressing force of the pickup roller against sheets. The pressing force changing mechanism is constituted by a solenoid, an actuator, or the like, and a dedicated drive source (such as a drive motor) for driving it. With such a sheet feeding device, it is possible to appropriately set the pressing force of the pickup roller against sheets by means of the pressing force changing mechanism, and thus it is possible to feed various types of sheets from thin sheets to thick sheets.

SUMMARY OF THE INVENTION

According to one aspect of the present disclosure, a recording medium feeding device includes a pickup roller, a feed roller, a rotation shaft of the feed roller, a retard roller, a holding member, a pressing mechanism, a pressing force changing mechanism, and a driving force transmitting mechanism. The pickup roller is configured to feed a recording medium by rotating while being pressed against a topmost surface of the recording medium stacked in a recording medium stacking portion. The feed roller is drivingly connected to the pickup roller and configured to feed a recording medium fed from the pickup roller toward a downstream conveyance path. The rotation shaft of the feed roller is connected to a drive source. The retard roller forms a conveyance roller pair together with the feed roller, and is configured to feed the recording medium while separating sheets of the recording medium one from another. The holding member is configured to rotatably support the feed roller and the pickup roller, and the holding member is swingable about the rotation shaft of the feed roller. The pressing mechanism is configured to press the pickup roller against the recording medium. The pressing force changing mechanism is configured to change a pressing force of the pickup roller against the recording medium. The driving force transmitting mechanism is configured to transmit a rotation-driving force from the drive source to the feed roller. The pressing force changing mechanism obtains a driving force from the driving force transmitting mechanism, and also increases the pressing force according to rotation time of the pickup roller.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to the accompanying drawings.

Figure 1:
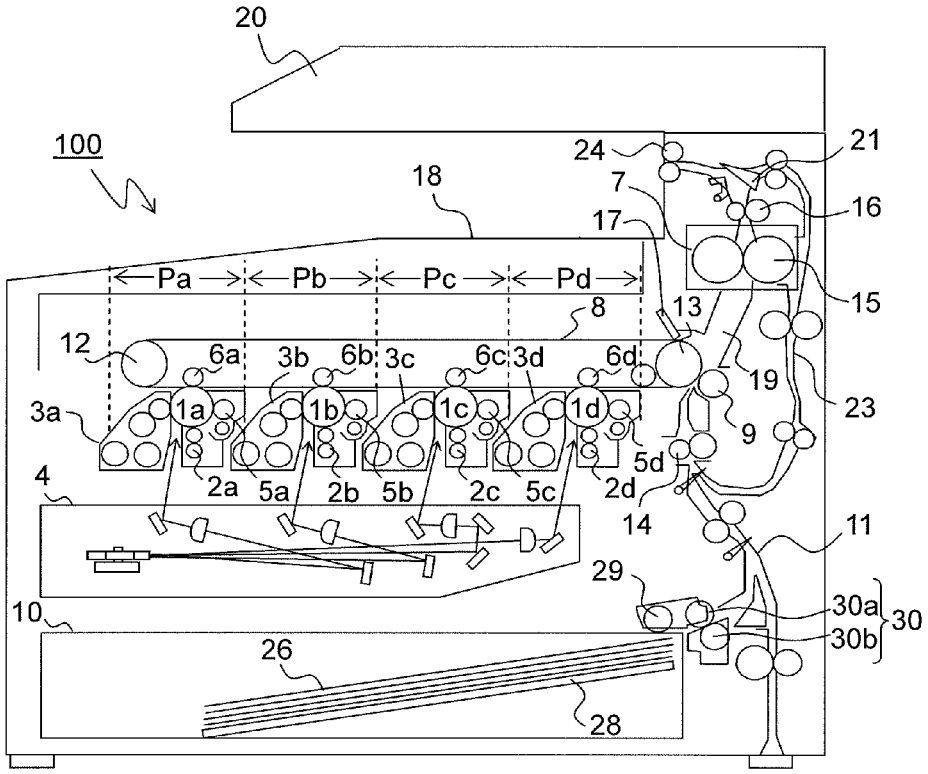
FIG. 1 is a sectional view showing an overall structure of an image forming apparatus according to an embodiment of the present disclosure.

With reference to FIG. 1 to FIG. 5, descriptions will now be given of an image forming apparatus 100 according to an embodiment of the present disclosure. As shown in FIG. 1, the image forming apparatus 100 is a tandem-type color copier, and in a main body of the image forming apparatus 100, four image forming portions Pa, Pb, Pc, and Pd are arranged in order from a left side in FIG. 1. The image forming portions Pa to Pd are provided corresponding to images of four different colors (yellow, magenta, cyan, and black), and the image forming portions Pa to Pd sequentially form yellow, magenta, cyan, and black images through steps of charging, exposing, developing, and transferring.

In these image forming portions Pa, Pb, Pc, and Pd, there are arranged photosensitive drums 1*a*, 1*b*, 1*c*, and 1*d*, respectively, each of which carries a visible image (a toner image) of a corresponding color, and further, an intermediate transfer belt 8 that rotates in a counterclockwise direction in FIG. 1 is provided adjacent to the image forming portions Pa to Pd. The toner images formed on these photosensitive drums 1*a* to 1*d* are transferred one after another and superimposed onto the intermediate transfer belt 8 moving in contact with the photosensitive drums 1*a* to 1*d*, and thereafter, the superimposed toner images are transferred onto a sheet 26 as an example of a recording medium by an operation of a secondary transfer roller 9, and further, the toner images on the sheet 26 are fixed thereon by a fixing device 7, and then the sheet 26 is ejected from the main body of the image forming apparatus 100. By rotating the photosensitive drums 1*a* to 1*d* in a clockwise direction in FIG. 1, an image forming process is carried out with respect to each of the photosensitive drums 1*a* to 1*d*.

The sheet 26 onto which the toner images are transferred is stored in a sheet feeding cassette (a recording medium stacking portion) 10 disposed in a lower part of the apparatus. Sheets 26 are stacked on a sheet stacking plate 28 of the sheet feeding cassette 10, and feeding out of the sheets 26 is started by rotating a pickup roller 29 in a state of being pressed against an upper surface of a topmost one of the sheets 26 with a predetermined pressure. Then, only the topmost sheet 26 is separated from the other sheets 26 by a conveyance roller pair 30, and is conveyed toward a sheet conveyance path (a downstream conveyance path) 11. After passing through the sheet conveyance path 11, the sheet 26 reaches a registration roller pair 14, and then, in accordance with a timing of image formation, the sheet 26 is conveyed to a nip portion between the secondary transfer roller 9 and a driving roller 13 of the intermediate transfer belt 8.

A dielectric resin sheet is used as a material of the intermediate transfer belt 8, and a (seamless) belt having no seam is mainly used. At a position downstream of the secondary transfer roller 9 in a moving direction of the intermediate transfer belt 8, there is disposed a cleaning blade 17 for removing toner remaining on a surface of the intermediate transfer belt 8.

An image reading portion 20 is constituted by, for example, a scanning optical system incorporating a scanner lamp that illuminates a document in a copying operation and a mirror that changes an optical path of light reflected from the document, a condenser lens that collects the light reflected from the document into an image, and a CCD sensor that converts the light of the formed image into an electric signal (none of which are illustrated), and the image reading portion 20 reads a document image and converts it into image data.

Next, the image forming portions Pa to Pd will be described. Charging devices 2*a*, 2*b*, 2*c*, and 2*d*, an exposing device 4, developing devices 3*a*, 3*b*, 3*c*, and 3*d*, and cleaning devices 5*a*, 5*b*, 5*c*, and 5*d* are disposed around and below the photosensitive drums 1*a* to 1*d*.

When image data is received from the image reading portion 20, first the charging devices 2*a* to 2*d* uniformly charge surfaces of the photosensitive drums 1*a* to 1*d*, and then the exposing device 4 irradiates the photosensitive drums 1*a* to 1*d* with light beams, and thereby electrostatic latent images are formed on the photosensitive drums 1*a* to 1*d* in accordance with the image data. The developing devices 3*a* to 3*d* are each provided with a developing roller (a developer carrier) disposed facing a corresponding one of the photosensitive drums 1*a* to 1*d*, and the developing devices 3*a* to 3*d* are respectively filled with predetermined amounts of two-component developers containing the toners of respective colors including yellow, magenta, cyan, and black. The toners are respectively supplied onto the photosensitive drums 1*a* to 1*d* by the developing rollers, to form toner images in accordance with the electrostatic latent images.

Then, the toner images formed on the photosensitive drums 1*a* to 1*d* are primarily transferred onto the intermediate transfer belt 8. Thereafter, toner remaining on the surfaces of the photosensitive drums 1*a* to 1*d* is removed by the cleaning devices 5*a* to 5*d*.

The intermediate transfer belt 8 is wound around and between a driven roller 12 and the driving roller 13. When the intermediate transfer belt 8 starts to rotate in a counterclockwise direction along with rotation of the driving roller 13, the sheet 26 is conveyed from the registration roller pair 14 to a nip portion (a secondary transfer nip portion) between the secondary transfer roller 9 and the intermediate transfer belt 8 at a predetermined timing, and at the nip portion, a full-color image is secondarily transferred onto the sheet 26.

The sheet 26 is conveyed to the fixing device 7, where heat and pressure is applied to the sheet 26 when it passes through a nip portion (a fixing nip portion) of a fixing roller pair 15 to fix the toner images on the surface of the sheet 26, and thereby a predetermined full-color image is formed. Thereafter, the sheet 26 passes through a conveyance roller pair 16 and reaches a branching portion of a sheet conveyance path 19. At the branching portion, the sheet 26 is directed by a conveyance guide member 21 disposed at the branching portion to one of a plurality of conveyance directions branched from the branching portion, and then, the sheet 26 is ejected as it is (or after it is sent to a double-sided copying conveyance path 23 and double-sided copying is completed thereon) to an ejection tray 18 via an ejection roller pair 24.

The sheet conveyance path 19 is configured to communicate with the ejection tray 18 or the double-sided copying conveyance path 23 at a position downstream of the conveyance roller pair 16.

Next, a description will be given of a configuration around the pickup roller 29.

Figure 2:
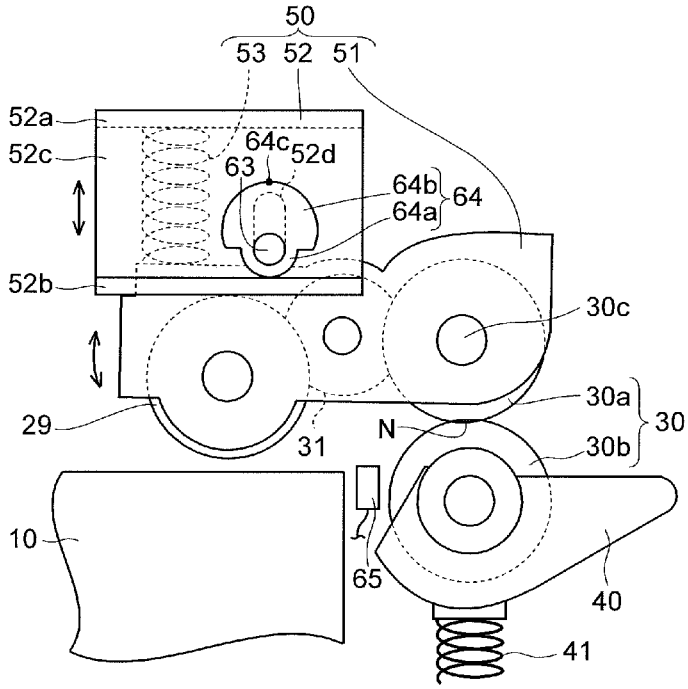
FIG. 2 is a sectional view showing a structure around a pickup roller of an image forming apparatus according to an embodiment of the present disclosure.

As shown in FIG. 2, the pickup roller 29, the conveyance roller pair 30, a later-described drive motor, a driving force transmitting gear 31, a pressing mechanism 50, a pressing force changing mechanism 60 (see FIG. 4), etc. constitute a recording medium feeding device. The pickup roller 29 feeds a sheet 26 from the sheet feeding cassette 10. The conveyance roller pair 30 includes: a feed roller 30*a* that conveys the sheet 26 fed thereto by the pickup roller 29; and a retard roller 30*b* that is disposed to face the feed roller 30*a* and forms a nip portion N for conveying the sheet 26 by pressing it against the feed roller 30*a*. Between the feed roller 30*a* and the pickup roller 29, the driving force transmitting gear 31 is disposed to transmit rotation of the feed roller 30*a* to the pickup roller 29.

The feed roller 30*a* and the retard roller 30*b* are configured to convey the sheets 26 fed by the pickup roller 29 one by one. Specifically, the feed roller 30*a* is mounted on a rotation shaft 30*c* connected to an unillustrated drive motor (a drive source), and is configured to be rotate by receiving a driving force from the drive motor. The retard roller 30*b* is configured to be rotated by being pressed against the feed roller 30*a*, and incorporates a torque limiter. Thereby, by rotating the pickup roller 29 in a state where it is pressed against the sheets 26, feeding out of the sheets 26 is started. In a case where a plurality of sheets 26 are fed out by the pickup roller 29 at once, the feed roller 30*a* and the retard roller 30*b* separates the sheets 26 one from another, such that a topmost one of the sheets 26 alone is fed toward the sheet conveyance path 11.

Here, a gear train (not shown) connecting the drive motor and the rotation shaft 30*c* to each other, the rotation shaft 30*c*, the feed roller 30*a*, the driving force transmitting gear 31, etc. constitute a driving force transmitting mechanism that transmits the rotation-driving force from the drive motor to the pickup roller 29.

The retard roller 30*b* is rotatably held by a retard roller holding member 40. At a lower part of the retard roller holding member 40, there is provided a first compression coil spring 41 by which the retard roller holding member 40 and the retard roller 30*b* are biased toward the feed roller 30 (upward). Thereby, the nip portion N is formed between the retard roller 30*b* and the feed roller 30*a*.

Furthermore, provided near the pickup roller 29 are the pressing mechanism 50 that presses the pickup roller 29 against the sheet 26, and the pressing force changing mechanism 60 (see FIG. 4) that changes a pressing force of the pickup roller 29 against the sheet 26.

The pressing mechanism 50 is constituted by a holding member 51 that holds the pickup roller 29, a contact member (an adjustment member) 52 that is disposed above and facing the holding member 51 and is movable with respect to a main body of the image forming apparatus (an apparatus main body), and a second compression coil spring (a biasing member) 53 that is disposed between the holding member 51 and the contact member 52.

The holding member 51 rotatably holds the pickup roller 29, the driving force transmitting gear 31, and the feed roller 30*a*. Furthermore, the holding member 51 is configured to be swingable about the rotation shaft 30*c* of the feed roller 30*a*.

A lower end of the second compression coil spring 53 is in contact with an upper surface of a pickup-roller-29-side part of the holding member 51, and an upper end of the second compression coil spring 53 is in contact with an upper surface (a later-described support surface portion 52*a*) of the contact member 52 from below. Thereby, the pickup-roller-29-side part (a swingable end) of the holding member 51 is pressed downward (toward the sheet).

Figure 3:
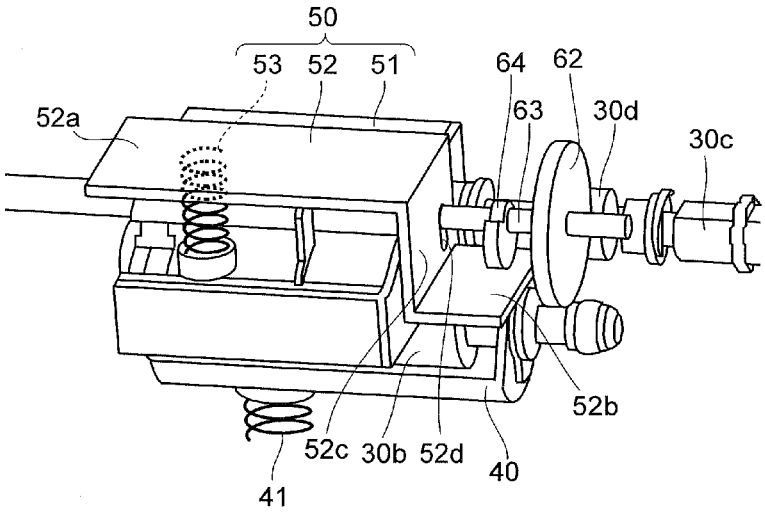
FIG. 3 is a perspective view showing a structure around a pressing mechanism of an image forming apparatus according to an embodiment of the present disclosure.

As shown in FIG. 2 and FIG. 3, the contact member 52 has the support surface portion 52*a* contacted by the upper end of the second compression coil spring 53, a contact portion 52*b* contacted by a later-described eccentric cam 64 from above, and a connection portion 52*c* that connects them to each other. In the connection portion 52*c*, there is formed a long hole 52*d* that extends in an up-down direction and through which a later-described rotation shaft 63 is inserted. The contact member 52 is moved (displaced) in the up-down direction by the later-described eccentric cam 64 contacting the Contact portion 52*b* while rotating (slidingly rotating). Here, the contact portion 52*b* and the eccentric cam 64 may be disposed on both sides of the contact member 52 (that is, both right and left sides in FIG. 3). With such a configuration, it is possible to displace the contact member 52 in a well-balanced manner.

Figure 4:
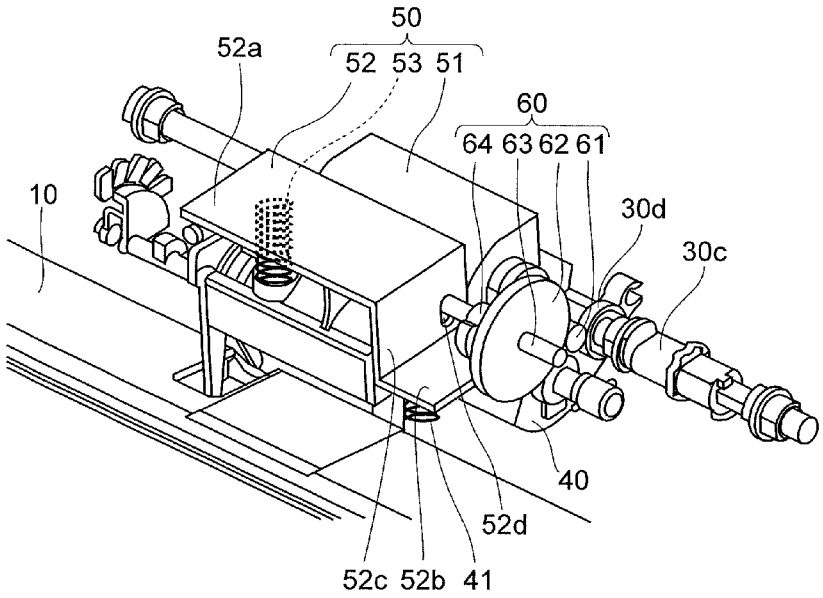
FIG. 4 is a perspective view showing a structure around a pressing mechanism of an image forming apparatus according to an embodiment of the present disclosure.
Figure 5:
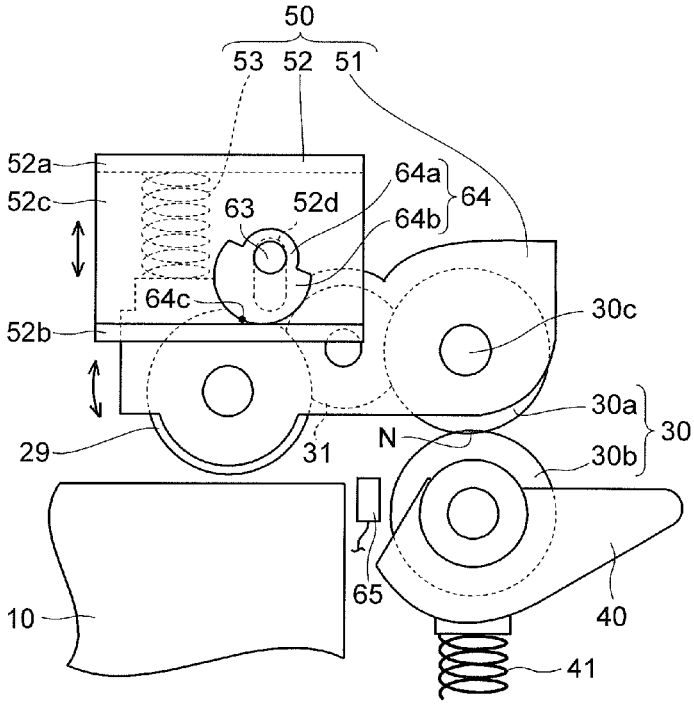
FIG. 5 is a sectional view showing a structure around a pickup roller of an image forming apparatus according to an embodiment of the present disclosure.

As shown in FIG. 4, the pressing force changing mechanism 60 is configured to obtain a driving force from the rotation shaft 30*c* of the feed roller 30*a*. Specifically, the pressing force changing mechanism 60 is constituted by an idle gear 61 that engages with an input gear (a transmission member, a small-diameter gear) 30*d* mounted on the rotation shaft 30*c* of the feed roller 30*a*, a cam driving gear (a transmission member, a large-diameter gear) 62 that engages with the idle gear (a transmission member) 61 and has a diameter larger than the input gear 30*d*, a rotation shaft (a transmission member) 63 on which the cam driving gear 62 is mounted, and the eccentric cam 64 mounted on the rotation shaft 63. The rotation shaft 63 is rotationably held by the apparatus main body. The cam driving gear 62 has more teeth than the input gear 30*d*, and thus, the rotation of the feed roller 30*a* is transmitted to the cam driving gear 62 in a decelerated state. Thereby, while the feed roller 30*a* and the pickup roller 29 rotate several times (for example, five times), the eccentric cam 64 makes approximately a half rotation.

The eccentric cam 64 includes a small-diameter portion 64*a* and a large-diameter portion 64*b* having a larger diameter than the small-diameter portion 64*a*. At a time when the pickup roller 29 starts picking up a sheet, the eccentric cam 64 is positioned such that the small-diameter portion 64*a* is below (closer to the contact portion 52*b* than) the large diameter portion 64*b* as shown in FIG. 2, and, after the pickup roller 29 rotates several times (five times, for example), the eccentric cam 64 is positioned such that the large-diameter portion 64*b* is below (closer to the contact portion 52*b* than) the small diameter portion 64*a*. That is, if misfeeding (poor sheet feeding (problem where the pickup roller 29 rotates idle despite that the pickup roller 29 is in contact with the sheet 26) occurs while the pickup roller 29 rotates a predetermined number of times (for example, two to three times) or more, the large diameter portion 64*b* of the eccentric cam 64 presses the contact portion 52*b* to move (displace) the contact member 52 downward to reduce a distance between the contact member 52 and the holding member 51. Here, the large diameter portion 64*b* has a maximum diameter point 64*c* that is disposed farthest from a center of the rotation shaft 63, so that a pressing force of the eccentric cam 64 against the contact portion 52*b* gradually increases until the maximum diameter point 64*c* comes into contact with the contact portion 52*b*. Furthermore, the eccentric cam 64 is configured such that its pressing force does not increase (the contact member 52 is not displaced downward) while the pickup roller 29 rotates at least one revolution (during time until a leading edge of the sheet 26 reaches a downstream conveyance roller disposed downstream of the conveyance roller pair 30 in a case where the sheet 26 has not been misfed).

Moreover, as shown in FIG. 2, at a position downstream of the pickup roller 29 in a sheet conveyance direction, there is provided a detection sensor 65 that detects presence/absence of a sheet 26. Thereby, it is possible to detect whether or not a sheet 26 has been fed by the pickup roller 29 (whether or not misfeeding has occurred).

When a sheet 26 is fed by the pickup roller 29, the sheet 26 is detected by the detection sensor 65, and after a rear edge of the sheet 26 passes through the nip portion N, the feed roller 30*a* is rotated backward. Thereby, the eccentric cam 64 returns to a home position (an original position (angle)) thereof. Here, the pickup roller 29 incorporates a one-way clutch, and thus the pickup roller 29 does not rotate backward even if the backward rotation of the feed roller 30*a* is rotated backward. The detection sensor 65 may be disposed upstream of the nip portion N in the sheet conveyance direction as shown in FIG. 2, or may be disposed downstream of the nip portion N in the sheet conveyance direction.

Next, a description will be given of a sheet feeding operation of the recording medium feeding device.

In performing a sheet feeding operation by means of the pickup roller 29, the drive motor (not shown) is driven, and thereby, the feed roller 30*a*, the driving force transmitting gear 31, and the pickup roller 29 are rotated (forward). Here, near the eccentric cam 64, there is provided a home-position switch (not shown) that detects the home position of the eccentric cam 64 (a position (angle) of the eccentric cam 64 in FIG. 2), and thereby, at a start of picking up, the eccentric cam 64 is positioned such that the small-diameter portion 64*a* is below (closer to the contact portion 52*b* than) the large diameter portion 64*b* as shown in FIG. 2.

In a case where the sheet 26 is a sheet of thin paper, regular paper, or the like, and no misfeeding due to the pickup roller 29 has occurred, the detection sensor 65 normally detects the sheet 26 by the time when the pickup roller 29 rotates once (one revolution). Then, when the leading edge of the sheet 26 reaches the downstream conveyance roller disposed downstream of the conveyance roller pair 30, the driving of the drive motor (not shown) is stopped to thereby stop the driving of the feed roller 30*a* and the pickup roller 29, and thereafter, the sheet 26 is conveyed by the downstream conveyance roller. Not only the pickup roller 29 but also the feed roller 30*a* incorporates a one-way clutch, and thus the pickup roller 29 and the feed roller 30*a* both idle with respect to their rotation shafts. At this time, rotation of the eccentric cam 64 is stopped. Thereafter, when the rear edge of the sheet 26 passes through the nip portion N, the eccentric cam 64 is rotated backward by an amount (an angle) by which the eccentric cam 64 has rotated forward, and returns to its home position (the position in FIG. 2). Thus, the pressing force of the pickup roller 29 against the sheet 26 does not increase.

On the other hand, in a case where the sheet 26 is a sheet of thick paper or the like, and misfeeding due to the pickup roller 29 has occurred, when the pickup roller 29 rotates a predetermined number of times (for example, two to three times), the eccentric cam 64 makes a quarter rotation into a position where the large-diameter portion 64*b* presses the contact portion 52*b*. Then, the contact member 52 is moved (displaced) downward, the second compression coil spring 53 is compressed (elastically deformed), and the pickup-roller-29-side part of the holding member 51 is moved (displaced) downward (the elastic deformation of the second compression coil spring 53 is increased), and thereby, the pressing force of the pickup roller 29 against the sheet 26 is increased.

Thereafter, if the misfeeding due to the pickup roller 29 has not been corrected yet, the pickup roller 29 further rotates and the eccentric cam 64 further rotates. At this time, the pressing force of the pickup roller 29 against the sheet 26 gradually increases until the maximum diameter point 64*c* of the eccentric cam 64 comes into contact with the contact portion 52*b*.

If the misfeeding due to the pickup roller 29 has been corrected, the sheet 26 is detected by the detection sensor 65. Then, the same operation as in the above case where no misfeeding has occurred is performed. Thereafter, after the rear edge of the sheet 26 passes through the nip portion N, the eccentric cam 64 is rotated backward by the amount (angle) by which it has been rotated forward, and returns to its home position (the position in FIG. 2).

Here, the above-mentioned backward rotation operation of the eccentric cam 64 is performed for each of the sheets 26, and even during continuous sheet feeding, it is performed each time the rear edge of a sheet 26 passes through the nip portion N. However, with a method in which the eccentric cam 64 is rotated backward at a timing when the rear edge of each sheet 26 passes through the nip portion N, in the case of continuous sheet feeding, a time interval between sheets becomes longer by the time taken to rotate the eccentric cam 64 backward. According to the present embodiment, since the pickup roller 29 and the feed roller 30*a* each incorporates a one-way clutch, even if the rotation shafts of the pickup roller 29 and the feed roller 30*a* are rotated backward to rotate the eccentric cam 64 backward, the pickup roller 29 and the feed roller 30*a* idly rotate with respect to their rotation shafts, and thus do not have negative effects on the conveyance of the sheets 26. Thus, the backward rotation operation of the eccentric cam 64 may be performed at a timing when the leading edge of a sheet 26 reaches the downstream conveyance roller. In this case, it is possible to reduce the increase of the time interval between sheets.

In a case where the misfeeding due to the pickup roller 29 has not been corrected even after the maximum diameter point 64*c* of the eccentric cam 64 has come into contact with the contact portion 52*b*, the driving of the pickup roller 29 is stopped, and an error message or an error-clearing method, for example, is displayed on the operation panel (not shown).

Incidentally, operations of the image forming apparatus 100 (the above described various rollers, the drive motor, the image forming portions Pa to Pd, the fixing device 7, etc.) are controlled by a control portion (not shown).

In the present embodiment, as described above, the pressing force changing mechanism 60 increases the pressing force if the pickup roller 29 has misfed while rotating the predetermined number of times or more. Thereby, it is possible to feed the sheet 26 while preventing creases from occurring in the sheet 26 in the case where the sheet 26 is, for example, a sheet of thin paper or regular paper. On the other hand, in the case where the sheet 26 is, for example, a sheet of thick paper, the pressing force changing mechanism 60 increases the pressing force of the pickup roller 29 against the sheet 26. Thereby, a conveyance force is further enhanced, and this makes it possible to feed the sheet 26. In this way, it is possible to feed sheets 26 of a wide variety of kinds.

Furthermore, the pressing force changing mechanism 60 obtains a driving force from the driving force transmitting mechanism. Thereby, need for providing a drive source (such as a drive motor) dedicated for the pressing force changing mechanism 60 is eliminated, and thus it is possible to prevent a structure and control of the recording medium feeding device from becoming complicated.

Moreover, as described above, the pressing force changing mechanism 60 includes the eccentric cam 64. Thereby, it is possible to configure the pressing force changing mechanism 60 such that it not only obtains a driving force form the driving force transmitting mechanism (the feed roller 30*a*, the rotation shaft 30*c*, etc.) but also is automatically driven by the driving force transmitting mechanism being driven.

Moreover, as described above, the pressing mechanism 50 includes the contact member 52, the holding member 51, and the second compression coil spring 53, and by the driving force transmitting mechanism (the feed roller 30*a*, the rotation shaft 30*c*, etc.) being driven, the eccentric cam 64 rotates to displace the contact member 52, and the second compression coil spring 53 is compressed to displace the holding member 51, and as a result, the pressing force of the pickup roller 29 against the sheet 26 is increased. Thereby, it is possible to easily increase the pressing force of the pickup roller 29 against the sheet 26 in the case where the pickup roller 29 has misfed while rotating the predetermined number of times or more.

Moreover, as described above, after the sheet 26 is conveyed by the forward rotation of the feed roller 30*a*, the pickup roller 29 rotates backward by the amount by which it rotates forward in feeding, and thereby the eccentric cam 64 returns to its home position. Thereby, it is possible to reduce the pressing force of the pickup roller 29 against the sheet 26 to its original level, and thus, even in a case where a sheet of, for example, thin paper or regular paper is to be fed next, it is possible to prevent creases from being formed in the sheet 26.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above discussion has dealt with a tandem-type color image forming apparatus as shown in FIG. 1, but the present disclosure is not limited to this. Needless to say, the present disclosure is applicable to various image forming apparatuses provided with a pickup roller, such as a monochrome copier, a monochrome printer, a digital multifunction peripheral, and a facsimile machine.

Furthermore, the above embodiments have dealt with examples where the recording medium feeding device of the present disclosure is employed in an image forming apparatus, but the recording medium feeding device of the present disclosure may be employed in apparatuses other than an image forming apparatus.

Moreover, the above embodiments have dealt with examples where a sheet feeding cassette is employed as the recording medium stacking portion where sheets (a recording medium) are stored, but instead, there may be employed a sheet feeding tray that is designed not for storing a recording medium therein but for just putting a recording medium thereon.

Furthermore, the above embodiments have dealt with examples where the pressing force changing mechanism increases the pressing force of the pickup roller if the pickup roller has misfed while rotating the predetermined number of times or more, but instead, the pressing force changing mechanism may increase the pressing force if the pickup roller has misfed for a predetermined period of time or longer. There is a definite relationship between the number of rotations and the rotation time of the pickup roller, increasing the pressing force according to the number of rotations of the pickup roller means substantially the same as increasing the pressing force according to the rotation time of the pickup roller.

Moreover, the above embodiments have dealt with examples where the pressing force changing mechanism is configured with an eccentric cam, but the pressing force changing mechanism may be configured without an eccentric cam.

What is claimed is:

1. A recording medium feeding device, comprising:

a pickup roller configured to feed a recording medium by rotating while being pressed against a topmost surface of the recording medium stacked in a recording medium stacking portion;

a feed roller drivingly connected to the pickup roller and configured to feed the recording medium fed thereto by the pickup roller toward a downstream conveyance path;

a rotation shaft of the feed roller, the rotation shaft being connected to a drive source;

a retard roller forming a conveyance roller pair together with the feed roller and configured to feed the recording medium while separating sheets of the recording medium one from another;

a holding member configured to rotatably support the feed roller and the pickup roller and swingable about the rotation shaft of the feed roller;

a pressing mechanism configured to press the pickup roller against the recording medium;

a pressing force changing mechanism configured to change a pressing force of the pickup roller against the recording medium; and a driving force transmitting mechanism configured to transmit a rotation-driving force from the drive source to the feed roller, wherein the pressing mechanism includes:

an adjustment member movable with respect to an apparatus main body and disposed to face the holding member, and a biasing member disposed between the holding member and the adjustment member and configured to bias the pickup roller toward the recording medium via the holding member; and the pressing force changing mechanism includes:

an eccentric cam configured to slidingly rotate in contact with the adjustment member to displace the adjustment member, and a transmission member connected to the driving force transmitting mechanism and configured to transmit the rotation-driving force to the eccentric cam; and the pressing force changing mechanism obtains a driving force from the driving force transmitting mechanism and increases the pressing force according to rotation time of the pickup roller.

2. The recording medium feeding device according to claim 1, wherein the biasing member is a coil spring; and by the driving force transmitting mechanism being driven, the eccentric cam is caused to rotate to displace the adjustment member such that a distance between the adjustment member and the holding member is reduced to cause elastic deformation of the coil spring, and the pressing force is increased by the elastic deformation of the coil spring being increased.

3. The recording medium feeding device according to claim 1, wherein the transmission member includes:

a small-diameter gear that is mounted on the rotation shaft of the feed roller; and a large-diameter gear that is mounted on a rotation shaft of the eccentric cam, that has a diameter larger than a diameter of the small-diameter gear, and to which a driving force is transmitted from the small-diameter gear.

4. The recording medium feeding device according to claim 3, wherein the eccentric cam is configured such that the pressing force does not increase while the pickup roller rotates at least one revolution.

5. The recording medium feeding device according to claim 1, wherein the feed roller is rotatable both forward and backward; and after the recording medium is conveyed by the forward rotation of the feed roller, the feed roller is driven to rotate backward to thereby cause the eccentric cam to rotate backward by an amount by which the eccentric cam rotates forward in feeding the recording medium to return to a home position thereof.

6. An image forming apparatus comprising the recording medium feeding device according to claim 1.

* * * * *